US006648037B2

(12) United States Patent
Chaisang

(10) Patent No.: US 6,648,037 B2
(45) Date of Patent: Nov. 18, 2003

(54) TEAK BOARD WITH STRAIGHT-LINE GRAIN AND MANUFACTURING PROCESS THEREFOR

(76) Inventor: Wutipong Chaisang, 441/12 Supakij Road, Nameung Sub District, Meung, Chacheungsao (TH), 24000

( * ) Notice: Subject to any disclaimer, the term of this patent is extended or adjusted under 35 U.S.C. 154(b) by 0 days.

(21) Appl. No.: 10/105,638

(22) Filed: Mar. 23, 2002

(65) Prior Publication Data

US 2003/0178100 A1 Sep. 25, 2003

(51) Int. Cl.[7] ..... B27D 11/00; B27B 1/00

(52) U.S. Cl. ..... 144/346; 52/745.19; 144/363; 144/378; 156/304.1; 156/250; 156/260; 156/264; 428/106

(58) Field of Search ..... 52/560, 574, 745.19; 144/346, 347, 363, 378, 314; 156/250, 259, 260, 304.1, 264, 265; 428/106, 107, 108

(56) References Cited

U.S. PATENT DOCUMENTS 186,893 A * 1/1877 Springer ..... 144/346
781,376 A * 1/1905 Sorensen ..... 144/346
2,344,426 A * 3/1944 Stamm ..... 144/214
2,942,635 A 6/1960 Horne
3,961,654 A 6/1976 Hasenwinkle
3,977,449 A * 8/1976 Sadashige ..... 144/346
4,122,878 A 10/1978 Kohn
4,691,751 A * 9/1987 Komulainen ..... 144/378
5,135,597 A 8/1992 Barker
5,593,530 A * 1/1997 Hashiguchi ..... 156/260
5,865,002 A * 2/1999 Tapojarvi ..... 428/106 X
5,968,625 A * 10/1999 Hudson ..... 428/106 X
6,025,053 A 2/2000 Grenier
6,286,571 B1 9/2001 Wiklund

* cited by examiner

*Primary Examiner*—W. Donald Bray
(74) *Attorney, Agent, or Firm*—Edward Gray

(57) ABSTRACT

Five processes for cutting teak wood timber so that the resulting logs have at least one straight-line grain surface and minimal surface area showing buds. Logs or thin sections thereof when aligned and glued together form boards or planks with straight-line grain surfaces.

11 Claims, 15 Drawing Sheets

TEAK BOARD WITH STRAIGHT-LINE GRAIN AND MANUFACTURING PROCESS THEREFOR

BACKGROUND OF THE INVENTION

1. Field of the Invention

This invention relates to the manufacturing of wood board, and more particularly to using teak heartwood and teak sapwood for making wood boards having surfaces with straight-line grain.

2. Description of the Related Art

Teak is a precious wood which has become increasingly rare in natural forests. Consequently, most teak wood now comes from trees cultivated in plantations where growth is managed so that a high proportion of trees will reach a good average height before flowering sets in, making branching more profuse. To obtain high quality wood from a cultivated tree it must have aged for over twenty-five years to be big enough to consist of a relatively large amount of heartwood compared to the amount of sapwood. The brown heartwood can be transformed into wooden boards with surfaces which have aesthetically pleasing straight-line grain patterns and are resistant to termites and to other insects and fungi. The white sapwood, which usually lacks line grain and is highly susceptible to fungus infection, is cut out and discarded. In managing a teak plantation it is necessary to do a thinning six or seven years after a "stand" is planted, in order that the remaining trees can have space to grow. Because the young, small trees cut down consist of a relatively large amount of sapwood compared to the amount of heartwood, their lumber generally is not used to manufacture boards but as flammable material or in cheap wall partitions.

OBJECTS OF THE INVENTION

It is an object of the present invention to provide processes for cutting teak lumber which allow portions of teak trees which heretofore have been discarded or used for low quality applications such as building cheap partitions and providing fuel, to be suitable for higher quality applications such as making furniture and decorative articles.

Another object of the invention is to provide processes for cutting teak sapwood lumber into logs which can be used to make boards having surfaces with straight-line grain pattern.

These and other objects as well as features and advantages of the invention will become further apparent from the detailed description and accompanying figures that follow. In the figures and description, numerals indicate the various features of the invention, like numerals referring to like features throughout both the drawings and description.

SUMMARY OF THE INVENTION

In one aspect the invention provides a process for manufacturing a teak board having at least one surface with straight-line grain. The process includes: (a) cutting a teak timber across its annual ring to form an end with a planar surface bounding four sectors having non-bud structure and four sectors having bud structure, the sectors alternating between non-bud and bud type with each including heartwood and sapwood; (b) cutting longitudinally through the planar surface along a first plurality of generally parallel lines and a second plurality of generally parallel lines generally orthogonal to the first plurality of lines, thereby forming a plurality of logs each having at least one side with straight-line grain; and (c) forming a board by aligning and contiguously attaching the logs so that at least one of the composite surfaces so formed has straight-line grain.

In another aspect the invention provides a teak wood board including a plurality of contiguously attached logs. Each log is predominately sapwood and has at least one surface with straight-line grain. The logs are aligned so that straight-line grain surfaces of the logs collectively form a straight-line grain surface of the board.

In still another aspect the invention provides a teak wood board including a plurality of contiguously attached logs. Each log is entirely sapwood and has at least one surface with straight-line grain. The logs are aligned so that straight-line grain surfaces of the logs collectively form a straight-line grain surface of the board.

In yet another aspect the invention provides a teak wood board including a plurality of contiguously attached planks. Each plank is entirely sapwood and has at least one surface with straight-line grain. The logs are aligned so that straight-line grain surfaces of the planks collectively form a straight-line grain surface of the board.

DESCRIPTION OF THE PREFERRED EMBODIMENTS

A. Introduction

Figure 1:
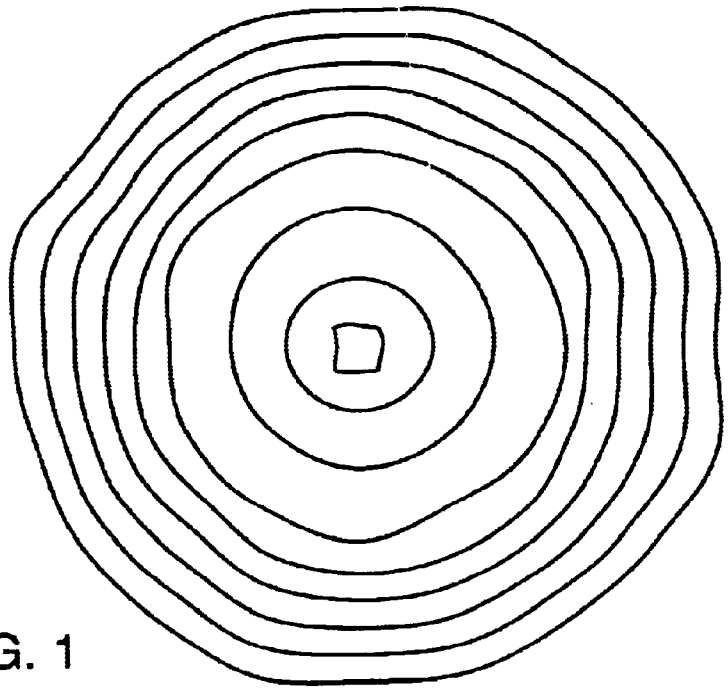
FIG. 1 shows a top plan view of a teak timber cut across the annual ring without any bud sectors.

While the present invention is open to various modifications and alternative constructions, the preferred embodiments shown in the drawings will be described herein in detail. It is to be understood, however, there is no intention to limit the invention to the particular forms disclosed. On the contrary, it is intended that the invention cover all modifications, equivalences and alternative constructions falling within the spirit and scope of the invention as expressed in the appended claims.

Where used herein the term "bud sector" or "bud-type sector" denotes a portion of a timber having bud structure cut from a teak tree across the annual ring (i.e., cross-cut generally transverse to the tree's length), the top surface of which (seen in a top plan view) is roughly a geometric sector whose vertex is proximate to the pith area. The term "bud-type grain" connotes a surface of a log, board or plank having a gnarled pattern. Similarly, where used herein the term "non-bud sector" connotes a portion of a timber having non-bud structure, and-the terms "straight-line" and "straight-line grain" mean that the log, board or plank referred to has at least one surface with a straight-line grain pattern. Where used herein the word "attached" means that the logs, boards or planks referred to are aligned and then glued or otherwise adhesively bonded together. However other forms of attachment may be suitable, consistent with simplicity of manufacture and reliability of the finished product.

Generally, when timber is cross-cut from a teak tree the annual ring appears as in FIG. 1. As one ring normally is formed each year, the eight rings in the FIG. 1 example imply the tree was eight years old. As a teak tree matures it develops protuberances called "buds" from which branches eventually grow. Buds form as opposed pairs along the trunk length, i.e., the two buds at a particular level are 180° apart, which are separated in phase by 90° from the bud pairs immediately above and below them. As the tree grows, sapwood is created just interior to the three outermost trunk layers, the outer bark, inner bark and cambium. Sapwood helps to transport sap and stores food for additional growth. Heartwood, which is interior to the sapwood, consists of inactive cells that have already performed their functions. Whether a timber portion consists of heartwood or sapwood or a combination of the two generally depends on radial distance from the pith, the small growth center of the tree. A particular heartwood or sapwood portion can have bud or non-bud structure, depending on whether or not it is proximate to a bud. In young trees where relatively little heartwood has formed, the nonbud and bud portions are likely to consist primarily if not totally of sapwood. Heretofore the sapwood portion of a teak timber has been considered useless for applications such as making board for high quality furniture. Only the heartwood portion has been used for making board with or without straight-line grain depending, respectively, on whether the timber does or does not have only non-bud structure.

Figure 4:
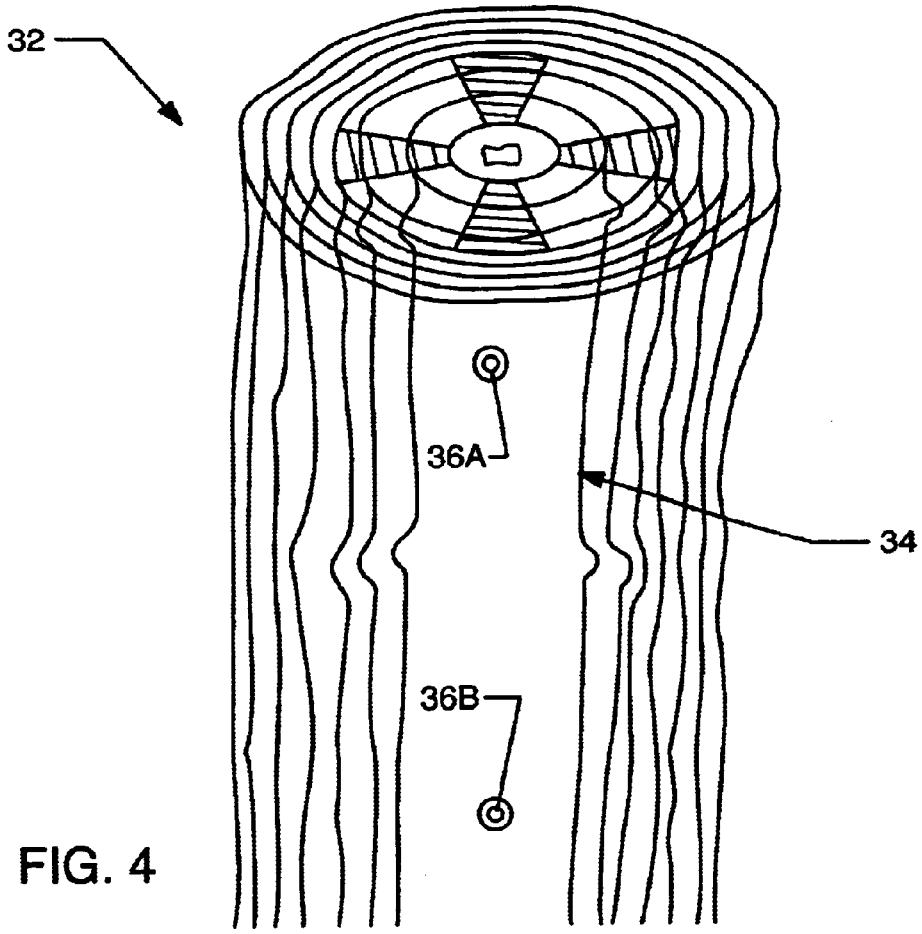
FIG. 4 shows a perspective view of a teak timber having one lengthwise region with bud structure.
Figure 2:
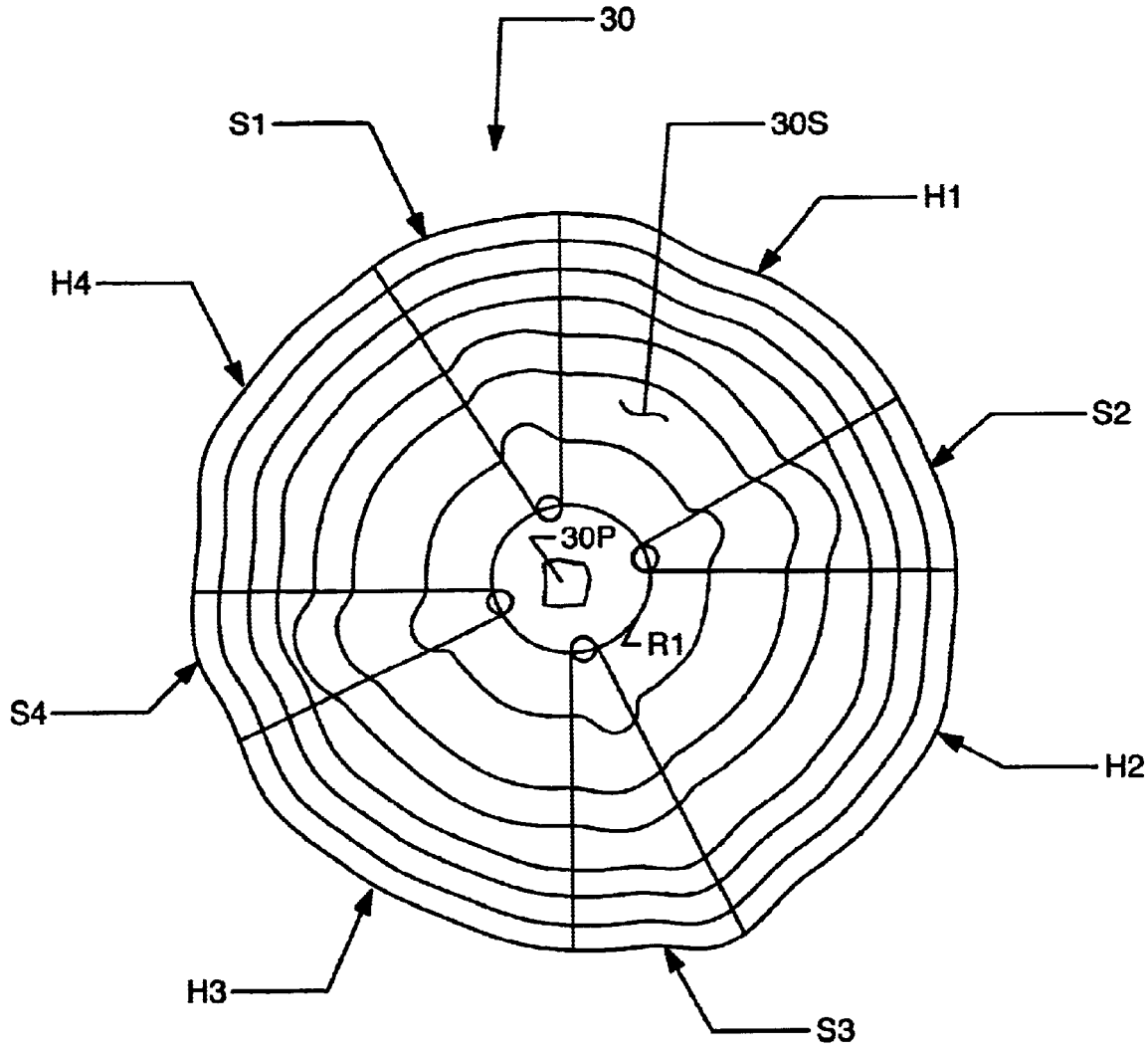
FIG. 2 shows a top plan view of a teak timber cut across the annual ring having four relatively large non-bud sectors and four relatively small bud sectors.
Figure 3:
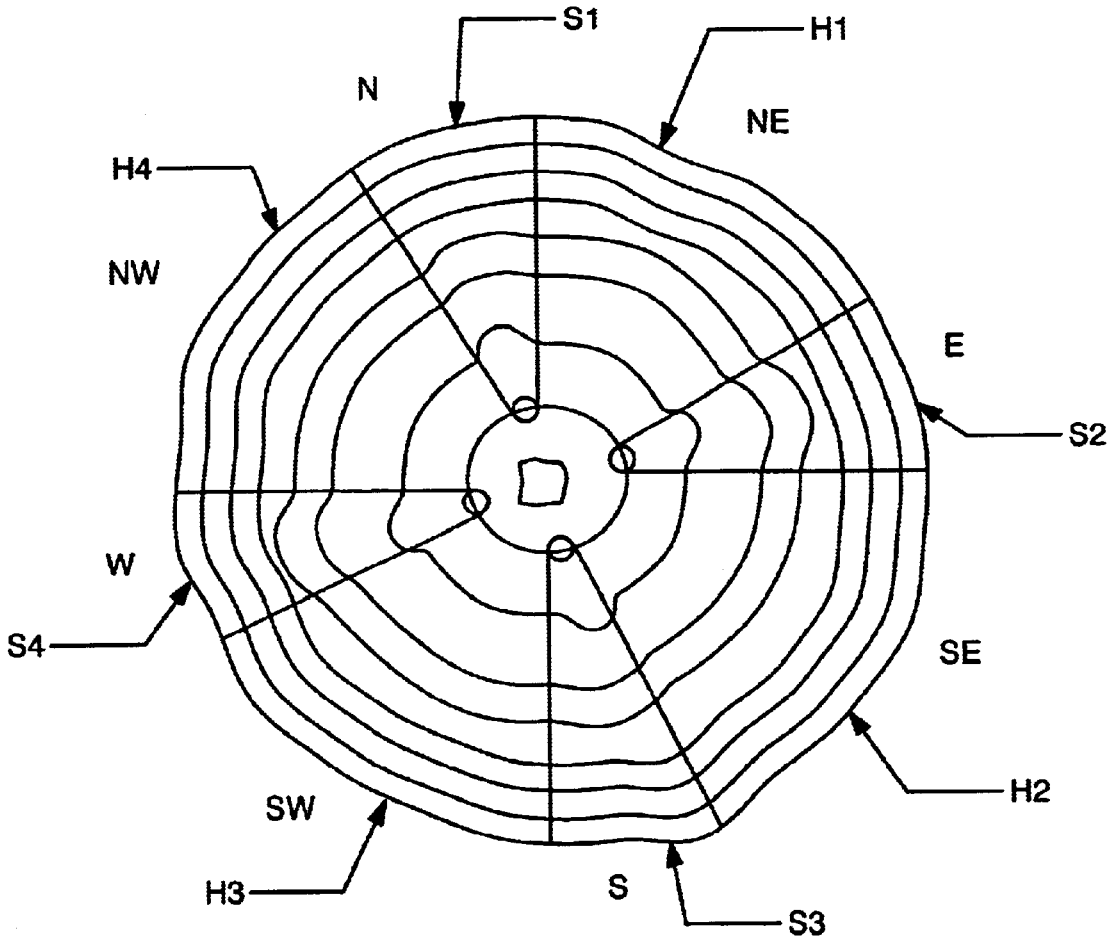
FIG. 3 illustrates, using the FIG. 2 timber as an example, a coordinate system for describing the relative disposition of non-bud and bud sectors.

Referring to FIG. 2, generally planar surface 30S is one end of a typical cross-cut teak timber 30 having a generally circular cross-section. Timber 30 includes four relatively large non-bud sectors H1, H2, H3, H4, and four relatively small bud sectors S1, S2, S3, S4 resulting from two pairs of opposed buds. The eight sectors extend along the length of the timber which terminates in an opposed cross-cut end. The vertex of each sector arbitrarily coincides with innermost ring R1 which circumscribes pith area 30P. Using timber 30 as an example, FIG. 3 illustrates a coordinate system for describing the relative disposition of non-bud and bud sectors. (Detailed descriptions of four of the five preferred embodiments are also referenced to FIG. 2.) The convention is to identify sectors on surface 30S in terms of points on a compass. Thus, bud sectors S1, S2, S3, S4 are at points N, E, S, W, respectively, and non-bud sectors H1, H2, H3, H4 are at points NE, SE, SW, NW, respectively. FIG. 4 schematically shows a teak timber 32 having a single longitudinal region 34 with bud structure as exemplified by knots 36A, 36B.

Figure 5:
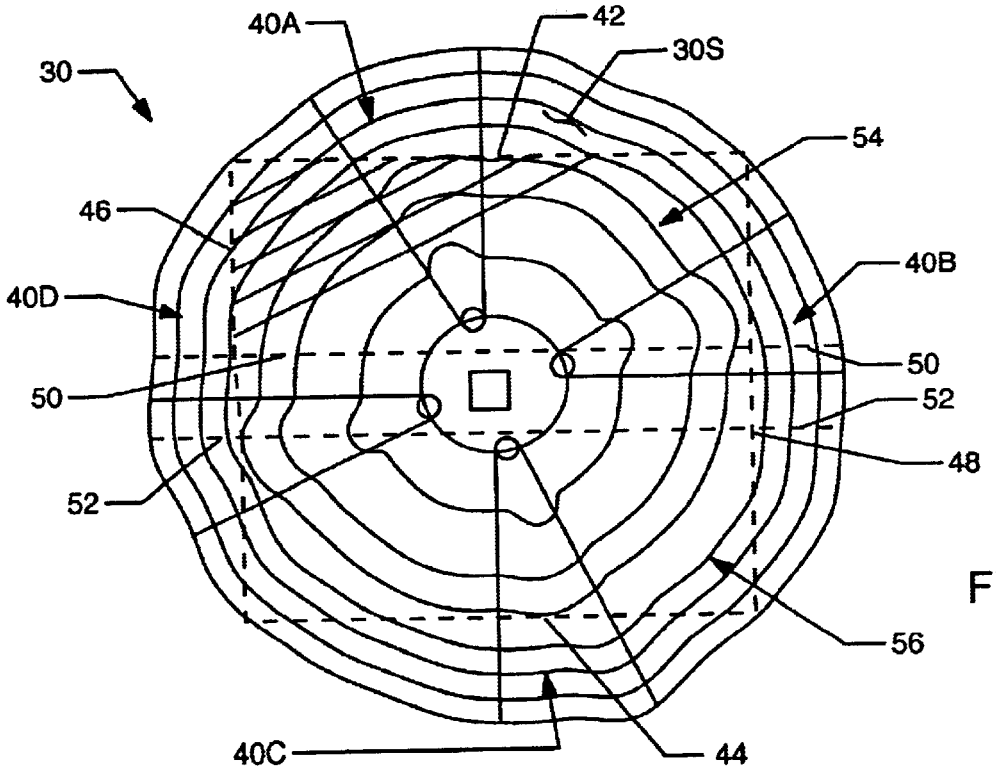
FIG. 5 shows the prior art process for cutting the FIG. 2 timber which forms two logs each having a combination of non-bud and bud structure. The dotted lines depict where the longitudinal cuts are made.
Figure 6:
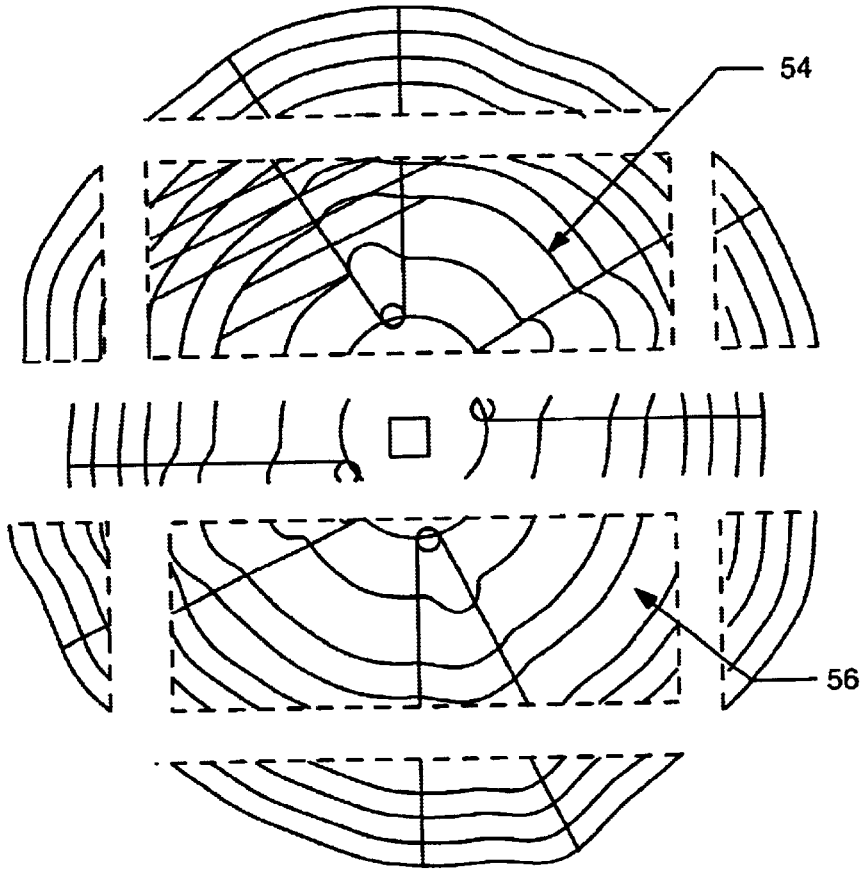
FIG. 6 shows the logs formed by the FIG. 5 process.
Figure 7:
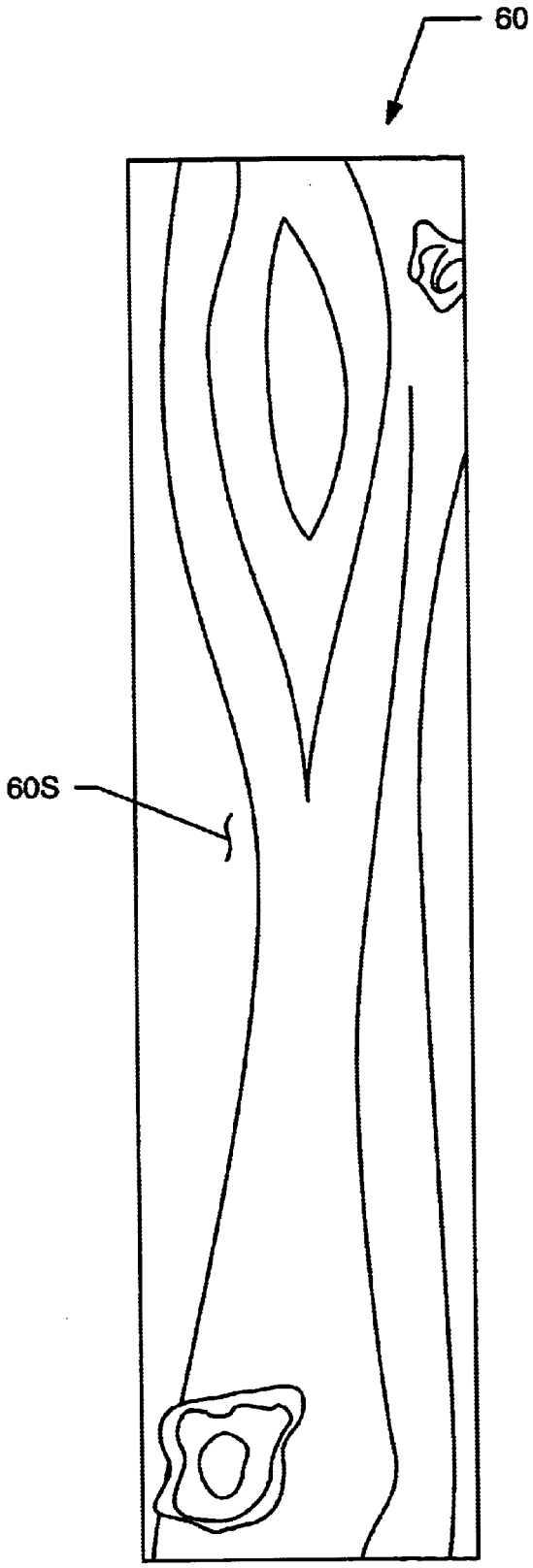
FIG. 7 shows a board made from the FIG. 6 log having a surface with bud-type grain.

With reference to timber 30, FIGS. 5 and 6 show the prior art process for longitudinally cutting a teak timber to obtain logs. The first step is to square off the timber. Portions 40A, 40B, 40C, 40D are carved away by cutting along two pairs of generally parallel dashed lines 42, 44 and 46, 48. Each dashed line is the intersection of a generally vertical cutting plane with the surface 30S. Next cuts are made along the opposed generally parallel pair of dashed lines 50, 52 to form a first log 54 having a relatively large amount of bud-type structure, and a second log 56 with a relatively small amount of bud structure. Both logs have a rectangular cross-section. This process, universal in the teak harvesting industry, wastes most of the timber and yields only a single desirable log. FIG. 7 shows a board 60 made from log 54, having a surface 60S whose bud-type grain pattern is typical of boards made from either sapwood or hardwood, depending upon the tree's age. In contrast, the present invention provides board with straight-line grain made from timber harvested from young teak trees which are substantially or even totally sapwood.

Embodiment 1

Figure 8:
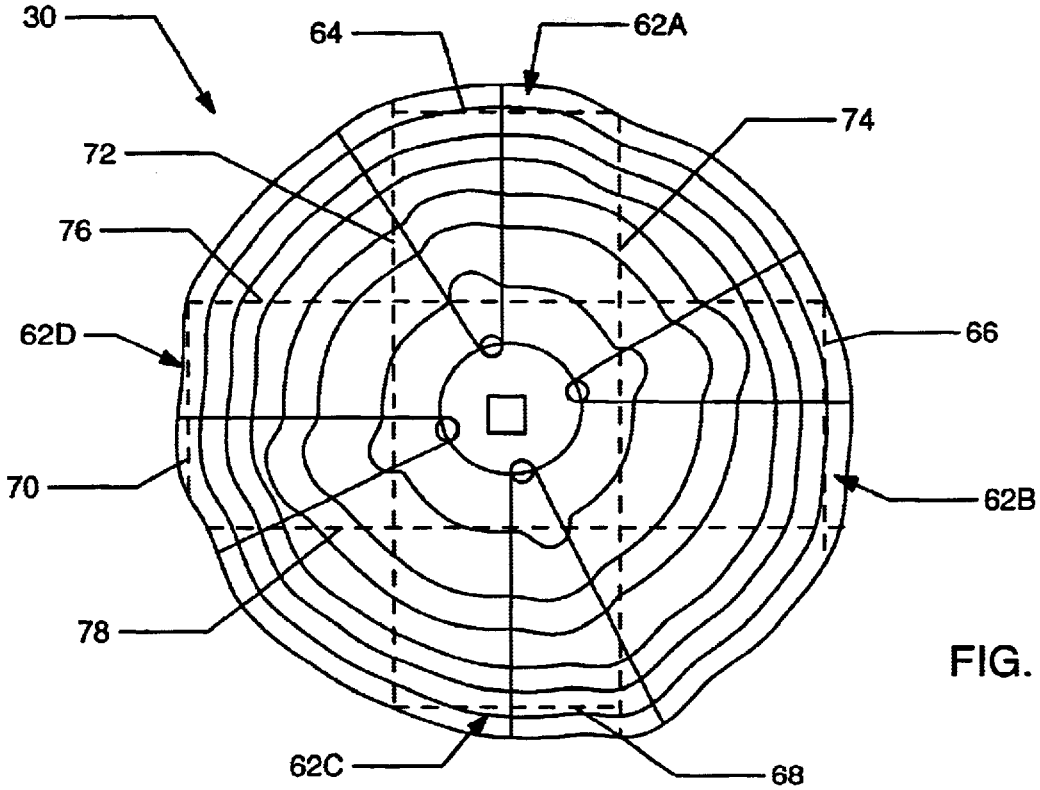
FIG. 8 shows a process for cutting the FIG. 2 timber according to a first embodiment of the invention wherein four logs are formed, each having one surface with bud structure.
Figure 9:
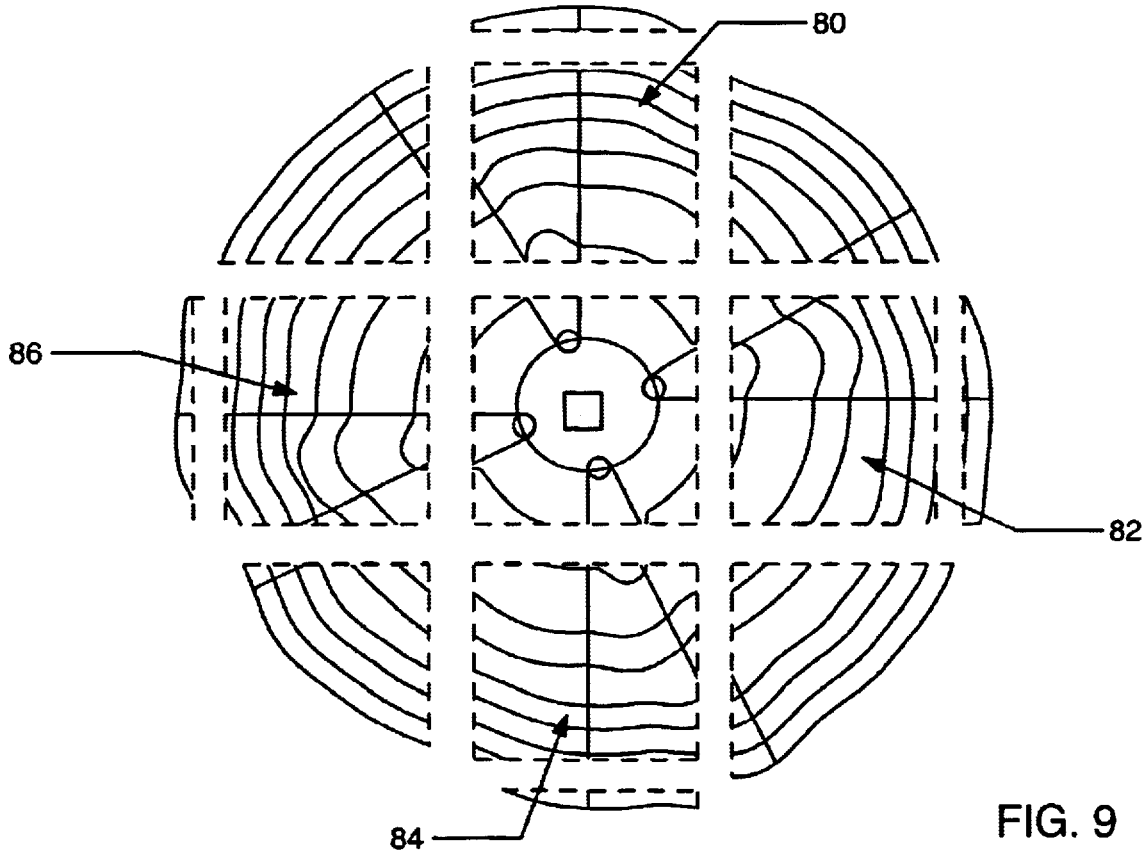
FIG. 9 shows the logs formed by the FIG. 8 process.
Figure 10:
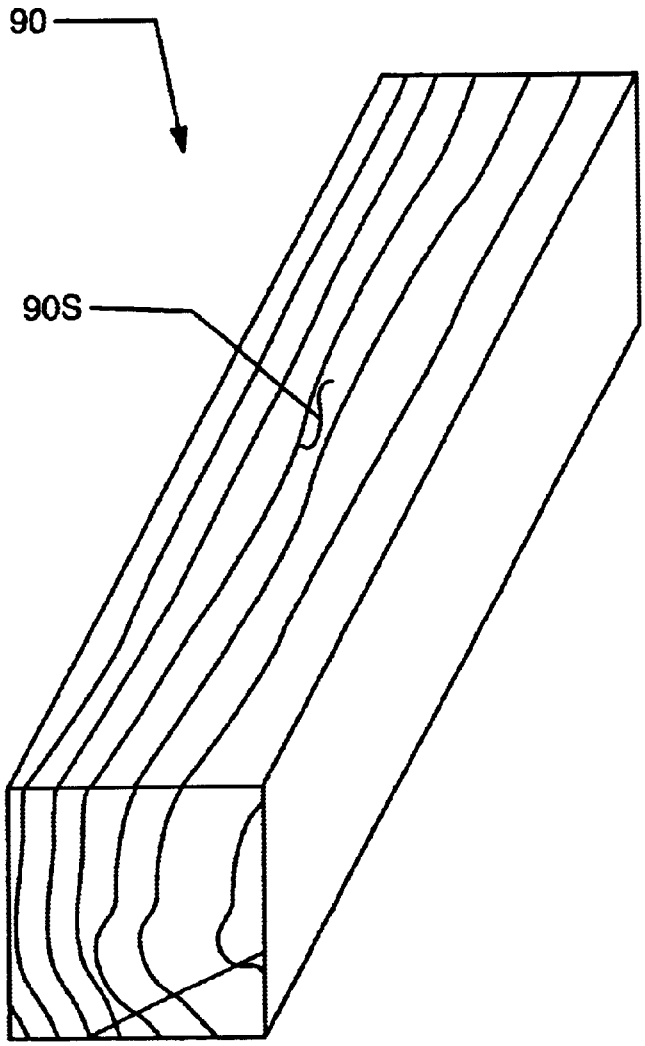
FIG. 10 shows a piece of wood cut from any one of the four FIG. 9 logs, having a surface with straight-line grain.
Figure 11:
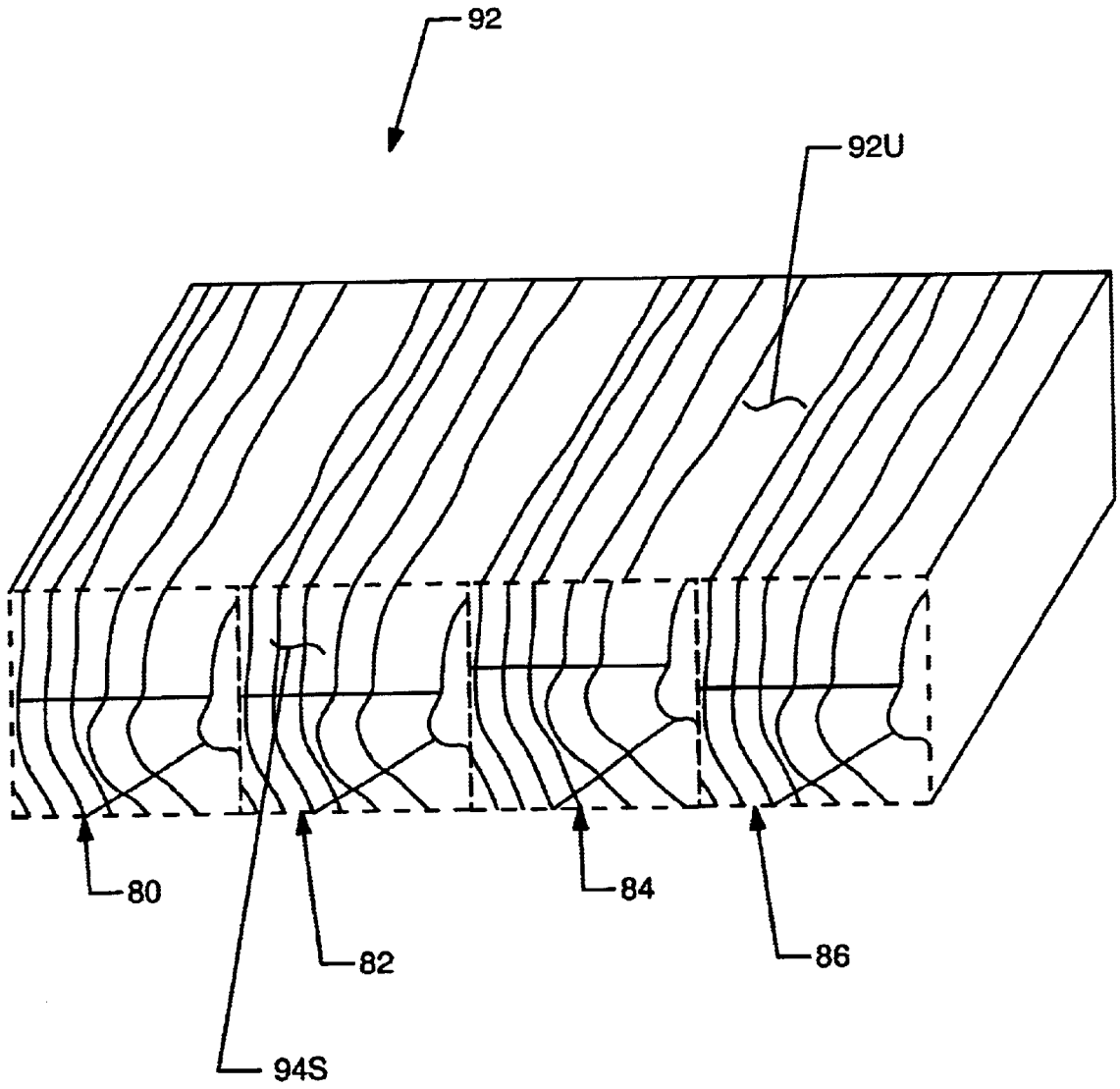
FIG. 11 shows four FIG. 10 pieces each smoothed on opposed sides before being aligned parallel and contiguously glued to form a board having an upper surface with straight-line grain, and a combination of straight-line and bud-type grain on one edge.

FIGS. 8 and 9 show how timber 30 is cut according to a first embodiment of the present invention to yield four square or rectangular cross-section logs from which pieces having a straight-line grain surface can be cut. Firstly, portions 62A, 62B, 62C, 62D are carved away by cutting along dashed lines 64, 66, 68, 70, respectively. Secondly, longitudinal cuts are made along opposed generally parallel dashed lines 72, 74, and opposed generally parallel dashed lines 76, 78 generally orthogonal to lines 72, 74, thereby forming four rectangular or square cross-section logs 80, 82, 84, 86 each having bud-type structure. In FIG. 8, line pairs 72, 74 and 76, 78 are symmetrically disposed with respect to pith area 30P so that the lines are approximately equidistant from the pith area, resulting in square cross-section logs. FIG. 10 shows a piece 90 with one straight-line grain surface 90S which may be cut from any one of the logs. FIG. 11 shows how logs 80, 82, 84, 86 after being smoothed on opposed sides can be aligned parallel and contiguously glued to form a board 92 having an upper surface 92U with straight-line grain, and an edge surface 94S having a combination of straight-line and bud-type grain. Most of the bud-type grain is hidden from view on lower surface 92L.

Embodiment 2

Figure 12:
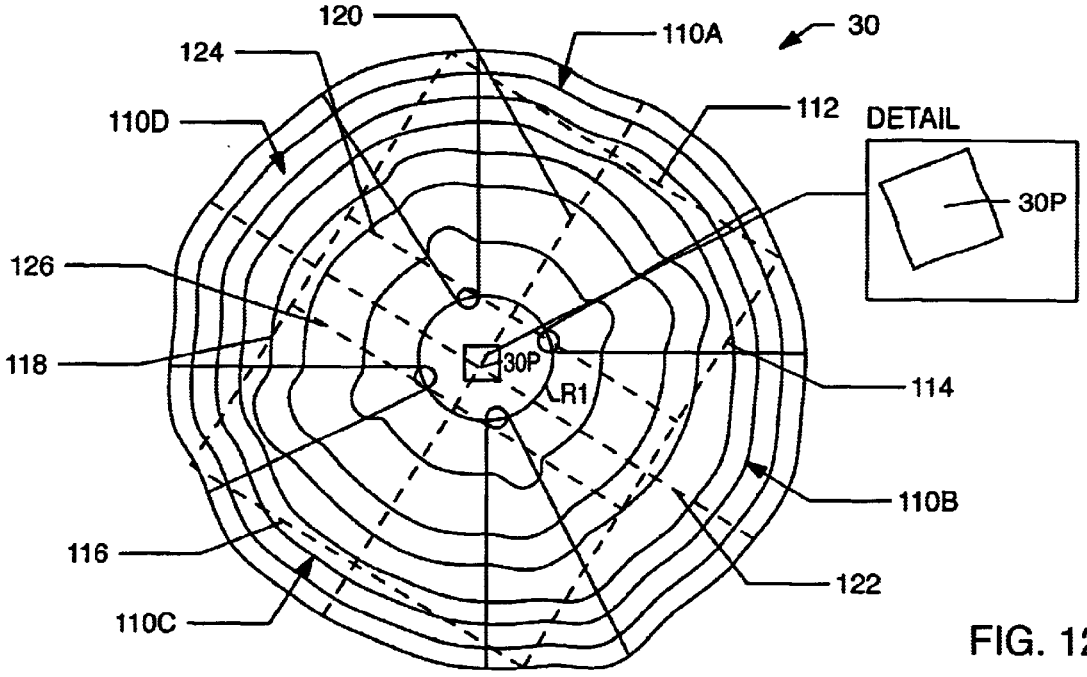
FIG. 12 shows a process for cutting the FIG. 2 timber according to a second embodiment wherein four logs with bud structure are formed.
Figure 13:
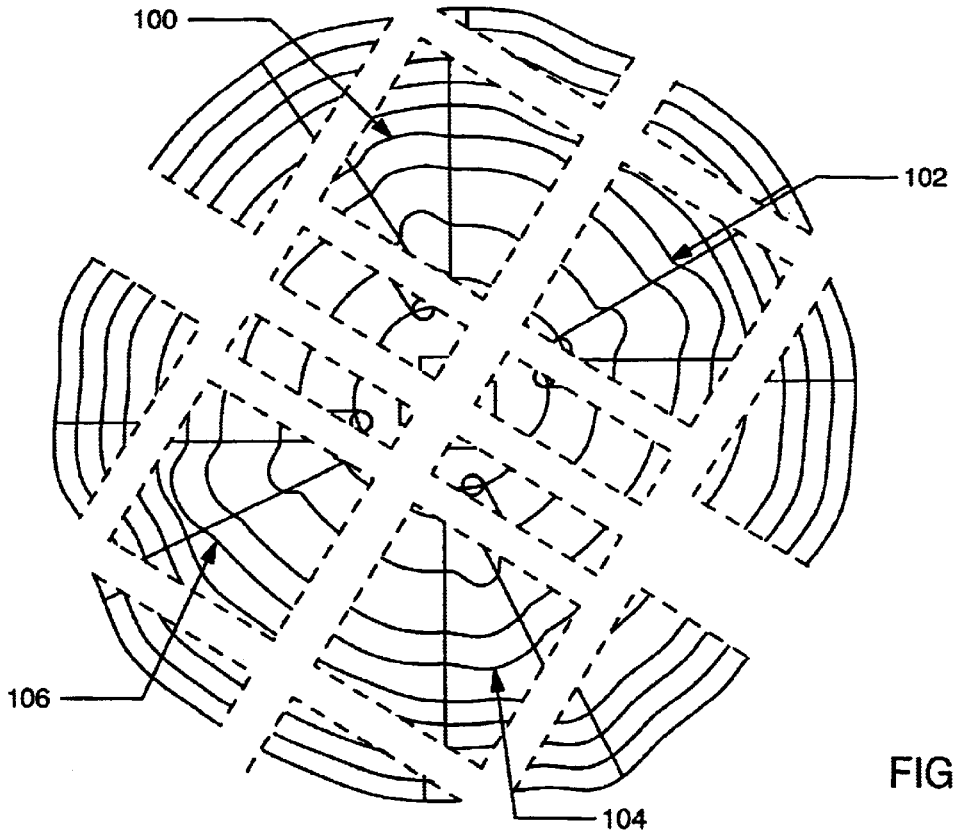
FIG. 13 shows the logs formed by the FIG. 12 process.
Figure 14:
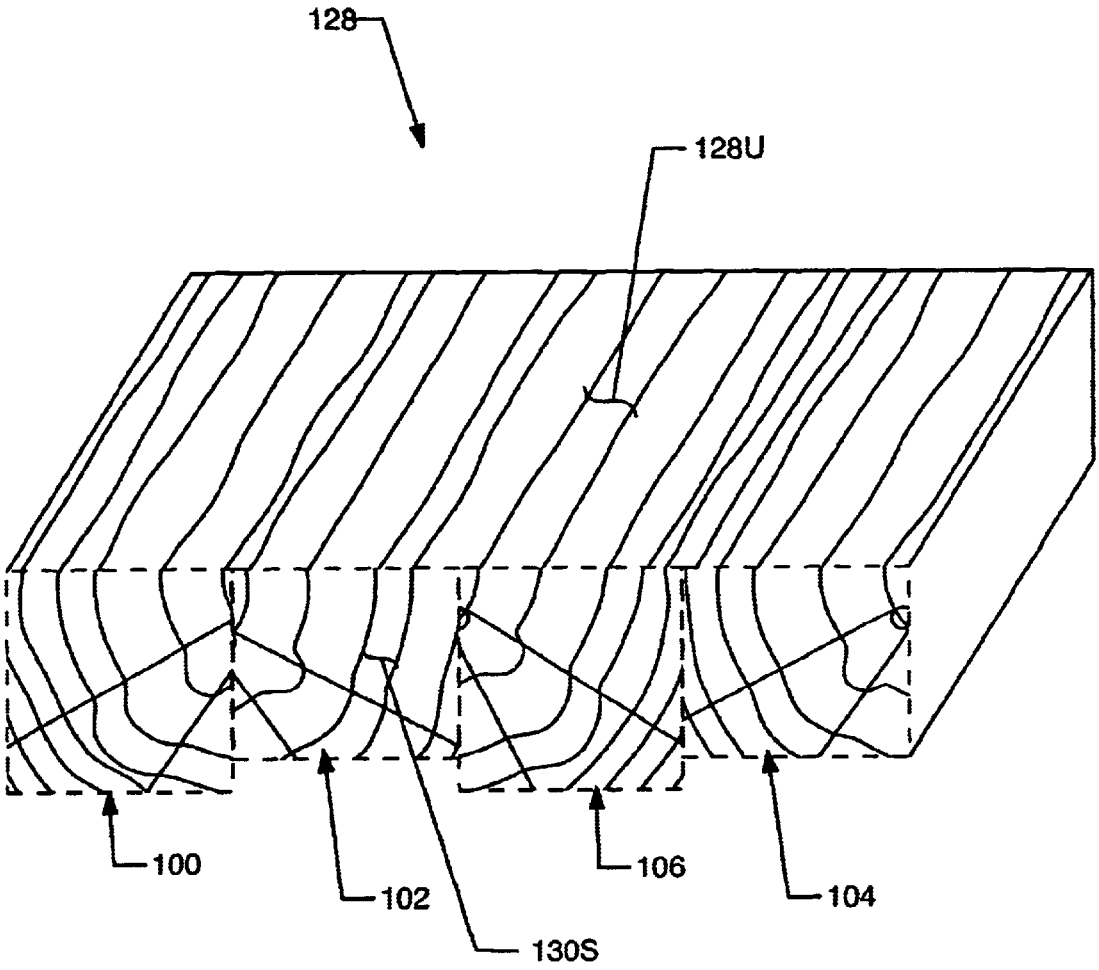
FIG. 14 shows the FIG. 13 logs, each smoothed on opposed sides before being aligned parallel and contiguously glued to form a board having an upper surface with straight-line grain, and an edge combining straight-line and bud-type grain.

FIGS. 12 and 13 show the timber 30 cut according to a second embodiment of the invention to yield four square cross-section logs 100, 102, 104, 106 each having a straight-line grain surface. Firstly, portions 110A, 110B, 110C, 110D are carved away by cutting along dashed lines 112, 114, 116, 118, respectively. Secondly, longitudinal diametral cuts through pith area 30P are made along generally orthogonal dashed lines 120, 122 which generally bisect the non-bud sectors H1, H2, H3, H4 (see FIG. 2), thereby quartering the timber. Thirdly, longitudinal cuts are made along opposed, generally parallel dashed lines 124, 126 proximate to innermost ring R1, thereby forming logs 100, 102, 104, 106. FIG. 14 shows the logs, after being smoothed on opposed sides, aligned and glued together to form a board 128 having an upper surface 128U with straight-line grain, and an edge surface 130S with bud-type grain.

Embodiment 3

Figure 15:
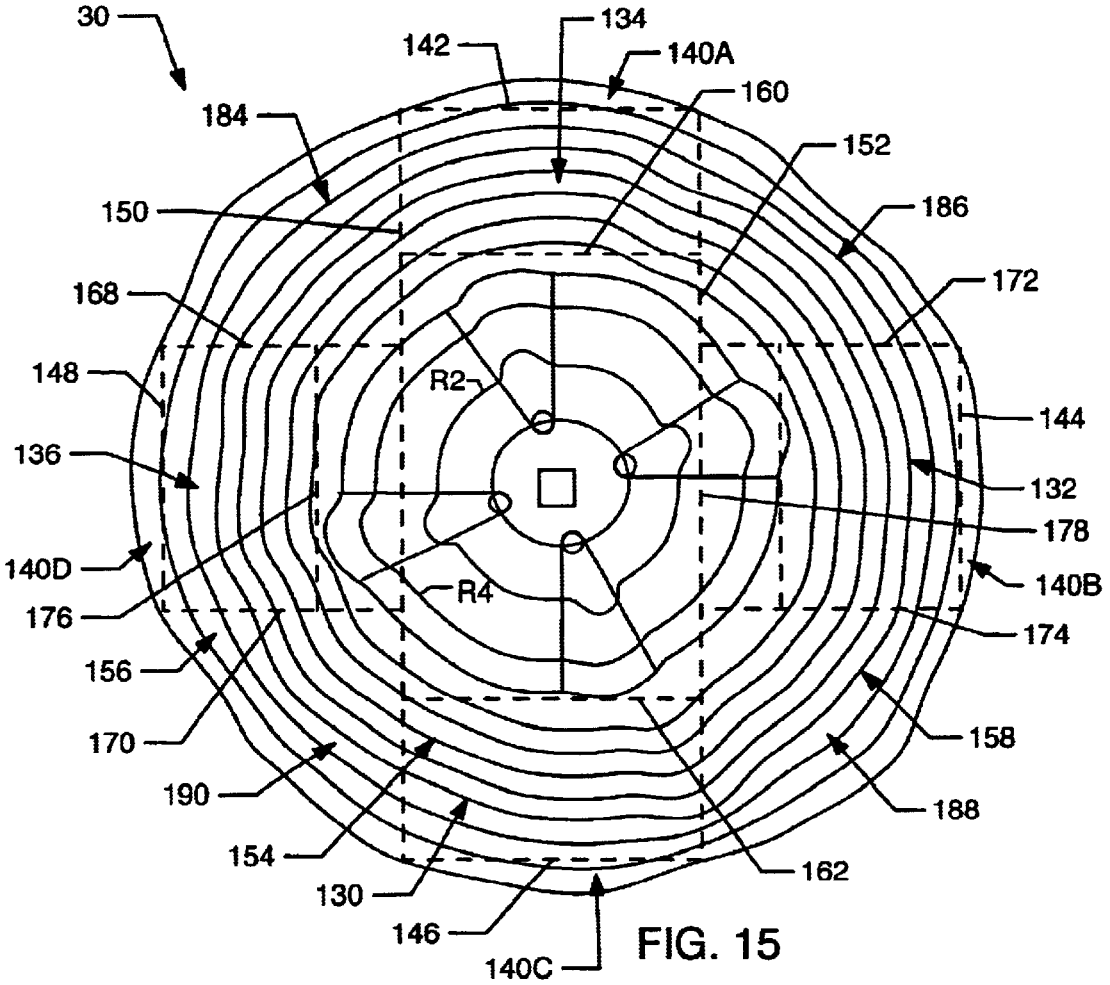
FIG. 15 shows a process for cutting the FIG. 2 timber according to a third embodiment wherein the cuts made avoid bud-type sectors so that four rectangular cross-section logs and four wedge-shaped cross-section logs are formed, all with non-bud structure.
Figure 16:
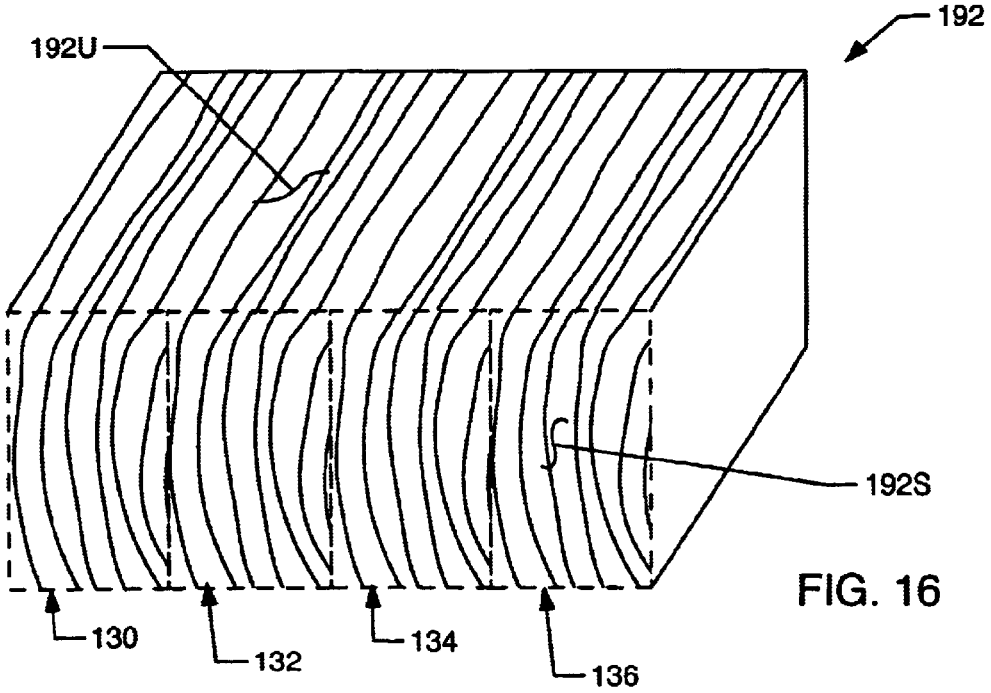
FIG. 16 shows the FIG. 15 rectangular cross-section logs, each smoothed on opposed sides before being aligned parallel and contiguously glued to form a board having an upper surface and an edge with straight-line grain.

FIG. 15 shows the timber 30 cut according to a third embodiment of the invention to yield four rectangular cross-section logs 130, 132, 134, 136 which are entirely sapwood but have non-bud structure. Firstly, portions 140A, 140B, 140C, 140D are carved away by cutting along dashed lines 142, 144, 146, 148, respectively. Secondly, longitudinal cuts are made along opposed, generally parallel dashed lines 150, 152 proximate to annual ring R2, dividing the timber into a generally rectangular block-shaped portion 154 and two semicylindrical-shaped portions 156, 158. Thirdly, portion 154 is longitudinally cut along opposed, generally parallel dashed lines 160, 162 proximate to ring R4 to form rectangular-shaped logs 134, 130, respectively. Fourthly, portions 156 and 158 are longitudinally cut along opposed, generally parallel dashed lines 168, 170 and 172, 174, respectively, and along dashed lines 176, 178, respectively, to form rectangular logs 136 and 132, respectively. Also formed are wedge-shaped portions 184, 186, 188, 190. FIG. 16 shows the logs 130, 132, 134, 136, after being smoothed on opposed sides, aligned and glued together to form a board 192 having an upper surface 192U and an edge surface 192S with straight-line grain.

Embodiment 4

Figure 17:
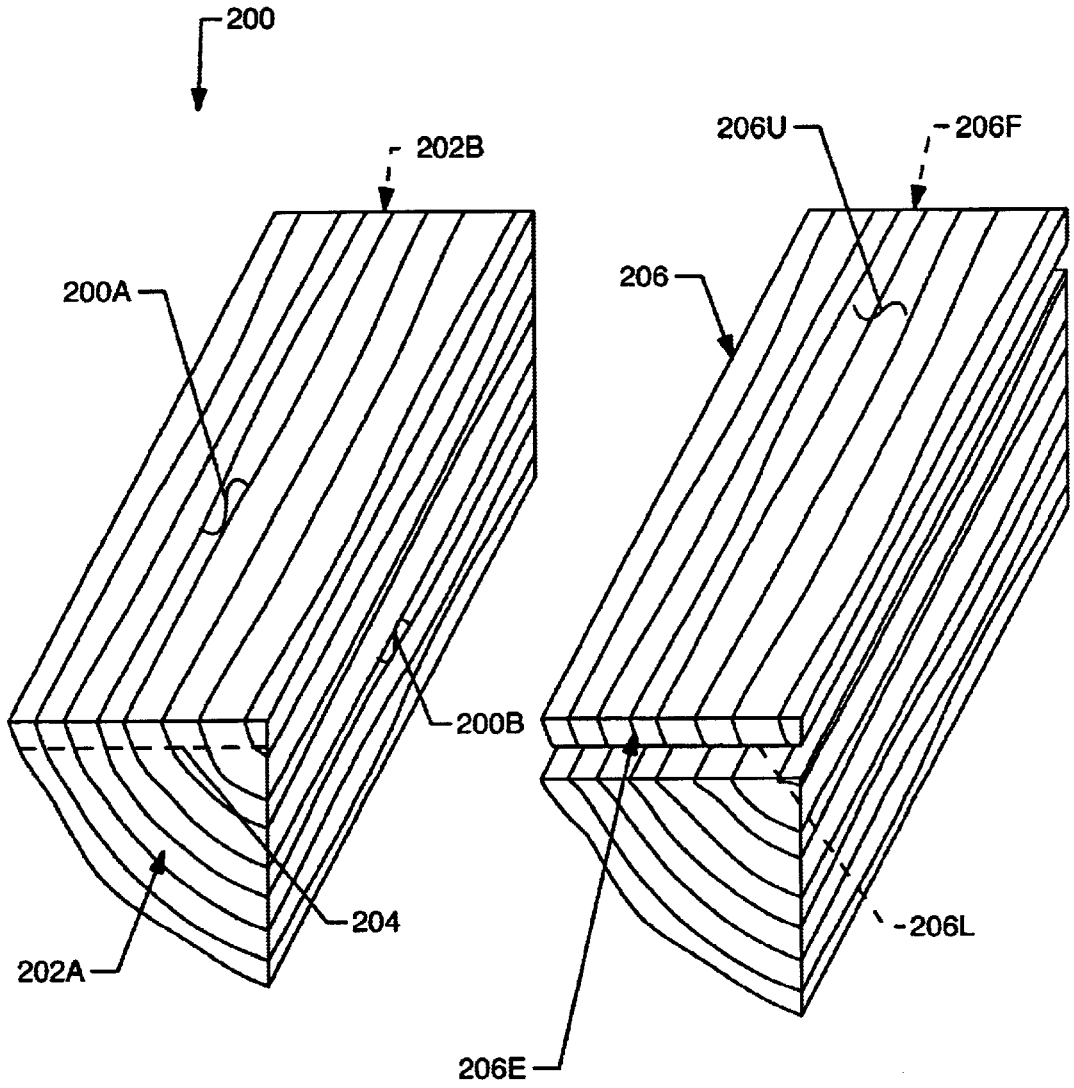
FIG. 17 shows a process according to a fourth embodiment for cutting a FIG. 15 wedge-shaped cross-section log to form thin pieces with straight-line grain.
Figure 18:
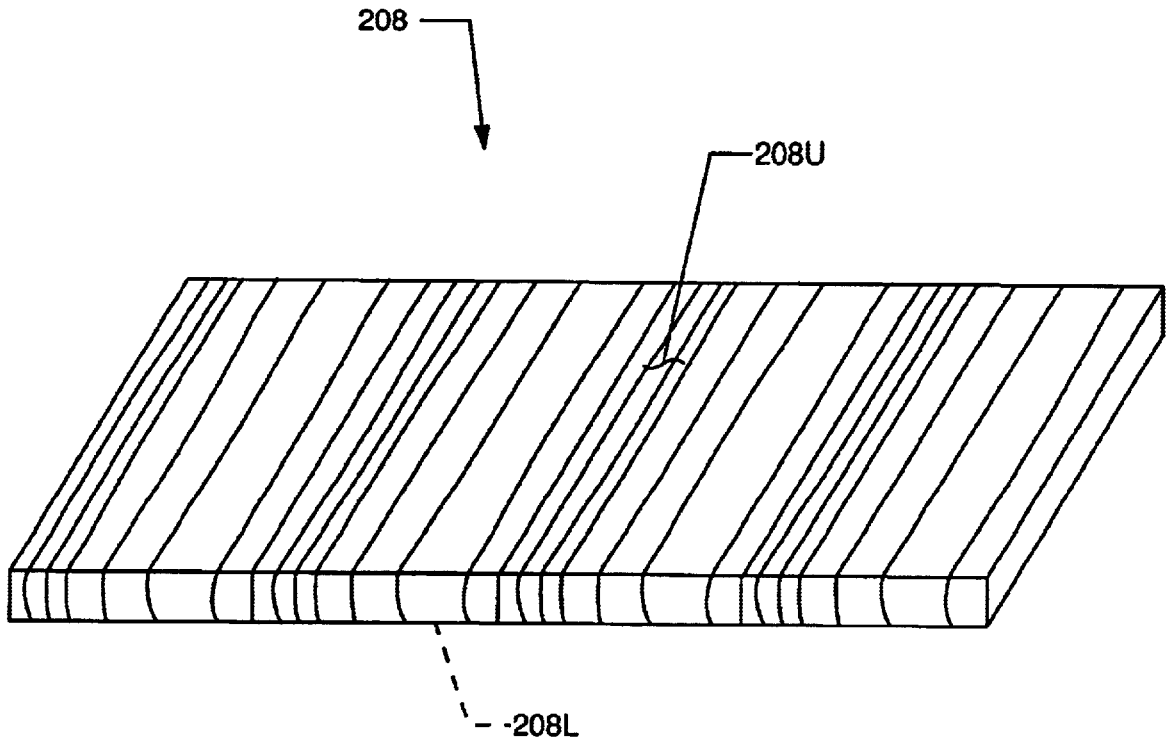
FIG. 18 shows a thin board made by aligning and contiguously gluing a plurality of FIG. 17 pieces.
Figure 19:
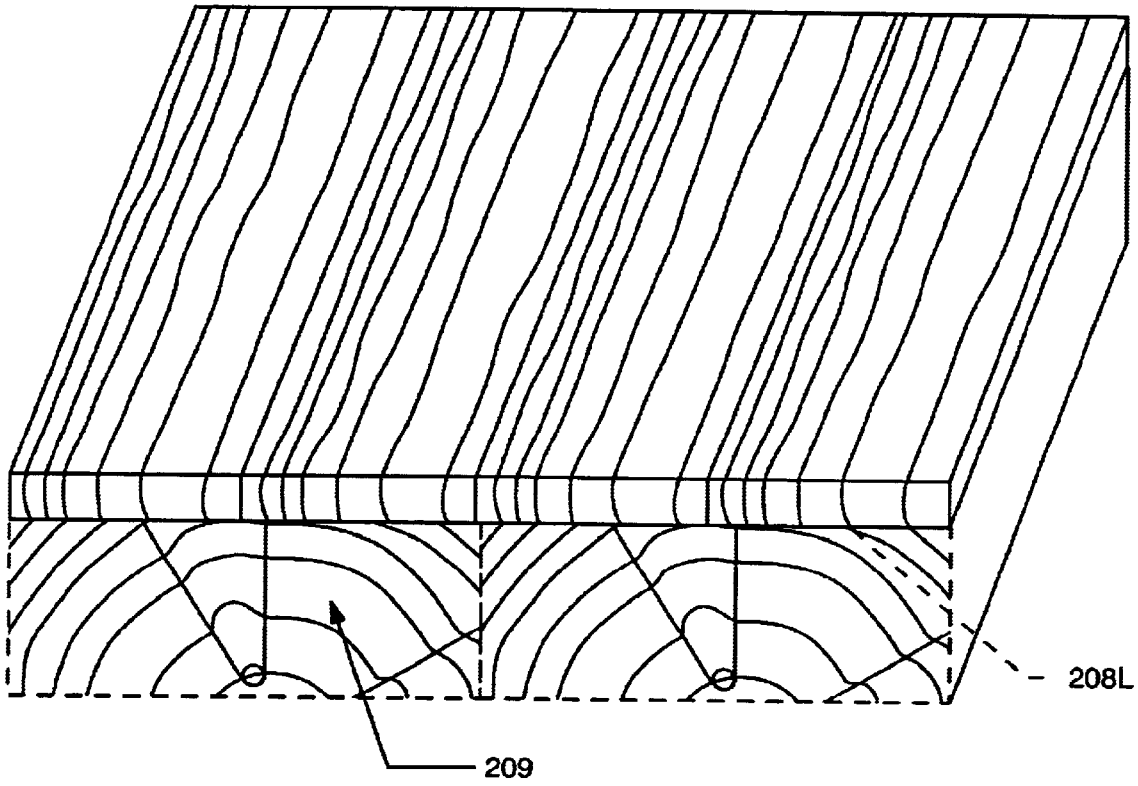
FIG. 19 shows how the FIG. 18 board can be strengthened by gluing underneath it a low quality board.

In a fourth embodiment of the invention, FIG. 17 shows how a wedge-shaped portion 200 formed as a byproduct of the third embodiment can be cut to form thin planks with straight-line grain. Because portion 200 has only non-bud structure, surfaces 200A, 200B and ends 202A, 202B all have straight-line grain. A longitudinal cut along dashed line 204 yields a plank 206 whose upper and lower surfaces 206U, 206L, respectively, and ends 206E, 206F all have straight-line grain. As shown in FIG. 18, a single portion can yield a plurality of planks which can be glued together to form a thin board 208 with upper and lower surfaces 208U, 208L, respectively. As shown in FIG. 19, the board can be strengthened by gluing a low quality board 209 to surface 208L.

Embodiment 5

Figure 20:
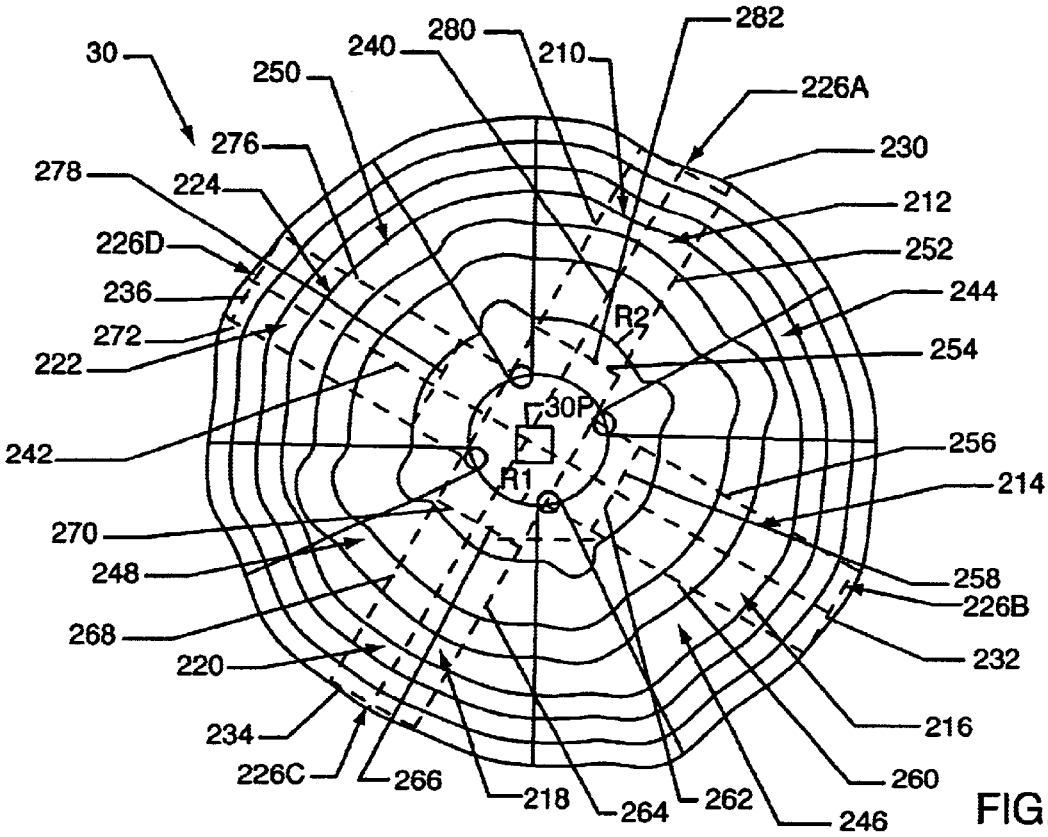
FIG. 20 shows a process for cutting the FIG. 2 timber according to a fifth embodiment wherein eight logs are formed each having non-bud structure.
Figure 21:
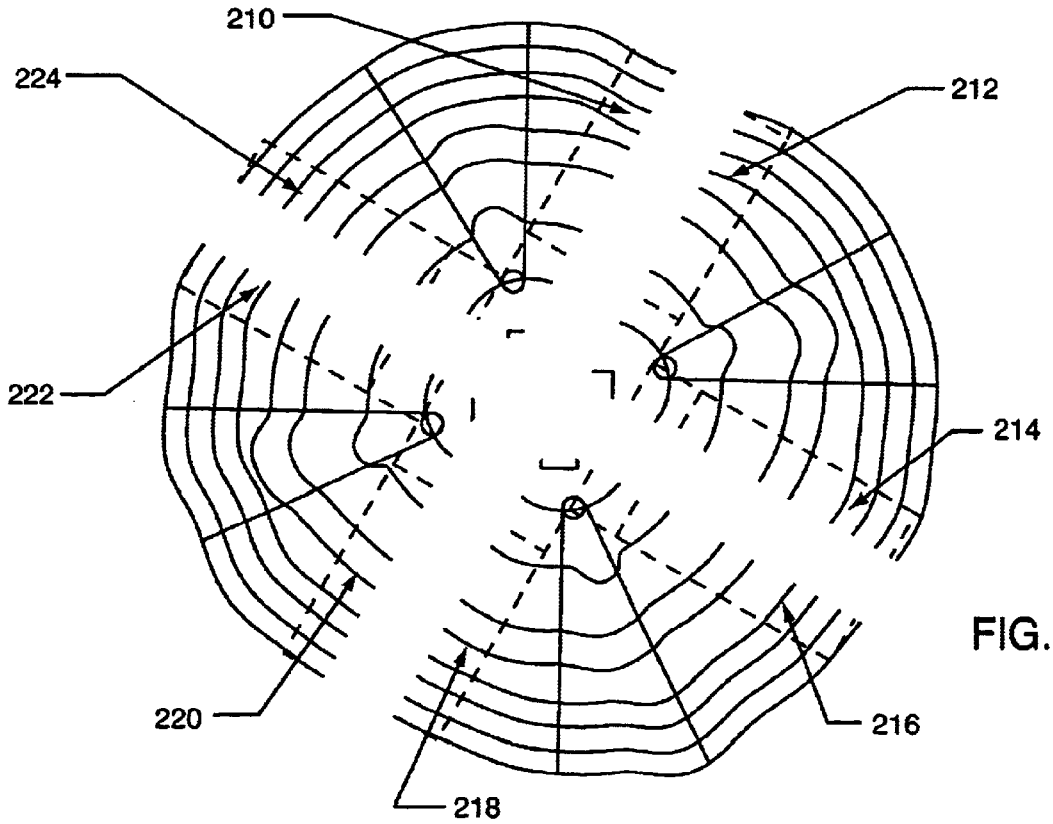
FIG. 21 shows the logs produced by the FIG. 20 process.

FIGS. 20 and 21 show the timber 30 cut according to a fifth embodiment of the invention to yield eight rectangular cross-section logs 210, 212, 214, 216, 218, 220, 222, 224 which include both heartwood and sapwood and have non-bud structure. Firstly, portions 226A, 226B, 226C, 226D are carved away by cutting along dashed lines 230, 232, 234, 236, respectively. Secondly, longitudinal diametral cuts through pith area 30P are made along generally orthogonal dashed lines 240, 242 which generally bisect the non-bud sectors H1, H2, H3, H4 (see FIG. 2), thereby dividing the timber into four sector-shaped portions 244, 246, 248, 250. Thirdly, two pairs of generally orthogonal cuts are made in each portion to form two logs. In portion 244 the cuts are along dashed lines 252, 254 and 256, 258; in portion 246 the cuts are along dashed lines 260, 262 and 264, 266; in portion 248 the cuts are along dashed lines 268, 270 and 272, 274; and in portion 250 the cuts are along dashed lines 276, 278 and 280, 282. Each of these cuts, which are generally parallel to diametral line 240 or 242, extends between an endpoint located between annual rings R1 and R2 and a squared-off end formed by cutting along line 230, 232, 234 or 236. As in the third embodiment, since the logs have only non-bud structure, they or boards made from them will have only straight-line grain on their upper and lower surfaces and opposed ends (see FIG. 16).

Trees from which timber is obtained should be at least four years old. Boards or planks produced according to any of the five embodiments must be chemically treated to protect against termites, insects and fungi. If the color of the timber portions from which logs are cut is not brown the logs must be dried before gluing before the manufacture of boards or planks can proceed. Finished boards and planks can be colored as desired with appropriate stains.

What is claimed is:

1. A process for manufacturing a teak board having at least one surface with straight-line grain, comprising the stops of:

cutting a teak timber determined by a circumferential outer surface across its annual ring thereby formning an end with a generally planar surface bounded by a circumferential perimeter, said planar surface bounding first, second, third and fourth sectors having non-bud structure, and first, second, third and fourth sectors having bud structure, each bud and non-bud sector having an inner heartwood portion and an outer sapwood portion, said inner and outer portions contiguous along a boundary, each bud sector contiguous to and disposed between two non-bud sectors, each non-bud sector contiguous to and disposed between two bud sectors, each sector having a vertex proximate to the pith area and terminating at said outer surface;

cutting longitudinally through said planar surface along a first plurality of generally parallel lines and a second plurality of generally parallel lines generally orthogonal to said first plurality of lines, each line determined by preselected endpoints on the planar surface, thereby forming a plurality of logs with a preselected common cross-section, each log having at least one side with straight-line grain; and forming a board by aligning and contiguously attaching the logs so that at least one of the composite surfaces so formed has straight-line grain.

2. The process of claim 1 wherein:

said first plurality of lines is four including an outer pair of opposed lines, each line having endpoints proximate to said perimeter and transiting sapwood in one bud sector and one non-bud sector, and an inner pair of opposed lines, each line having endpoints proximate to said perimeter and transiting sapwood and heartwood in two bud sectors and two non-bud sectors;

said second plurality of lines is four including an outer pair of opposed lines, each line having endpoints proximate to said perimeter and transiting sapwood in one bud sector and one non-bud sector, and an inner pair of opposed lines, each line having endpoints proximate to said perimeter and transiting sapwood and heartwood in two bud sectors and two non-bud sectors; and said plurality of logs is four.

3. The process of claim 2 wherein each said log is predominately sapwood and has a generally square crossction and two generally rectangular and mutually orthogonal sides having straight-line grain.

4. The process of claim 1 wherein:

said first plurality of lines is three including a diarnetral line transiting the pith area and sapwood and heartwood in two opposed non-bud sectors, and an outer pair of opposed lines, each line having endpoints proximate to said perimeter and transiting sapwood and heartwood in two bud sectors and one non-bud sector;

said second plurality of lines is five including a diarnetral Line transiting the pith area and sapwood and heartwood in two opposed non-bud sectors, an outer pair of opposed lines, each line having endpoints proximate to said perimeter and transiting sapwood in tow bud sectors and one non-bud sector, and an inner pair of opposed lines, each line having endpoints proximate to said boundary and transiting heartwood in opposed non-bud sectors; and said plurality of logs is four.

5. The process of claim 4 wherein each said log includes heartwood and sapwood, and has a generally square cross-section and one generally rectangular side having straight-line grain.

6. The process of claim 1 wherein:

said first plurality of lines is six including an outer pair of opposed lines, each line having endpoints proximate to said perimeter and transiting sapwood in one bud sector and one non-bud sector an inner pair of opposed lines, each line having endpoints proximate to said perimeter and transiting sapwood and hartwood in two bud sectors and two non-bud sectors, and a pair of opposed lines disposed between said outer and inner lines, each line having endpoints proximate to said boundary and transiting one bud sector and one non-bud sector;

said second plurality of lines is eight including an outer pair of opposed lines, each line having endpoints proximate to said perimeter and transiting sapwood in one bud sector and one non-bud sector, a pair of opposed lines, each line approximately tangential to said boundary and having endpoints at its intersections with said inner pair of opposed lines of said first plurality of lines, and first and second inner pairs of opposed lines, each line having an endpoint proximate to said perimeter and an endpoint at its intersection with one of said inner pair of opposed lines of said first plurality of lines; and said plurality of logs is four.

7. The process of claim 6 wherein each said log is entirely sapwood and has a rectangular cross-section and one generally rectangular side with straight-line grain.

8. The process of claim 1 wherein:

said first plurality of lines is four including first and second pairs of opposed lines, each line having one endpoint on said perimeter and one endpoint proximate to said boundary;

said second plurality of lines is four including first and second pairs of opposed lines, each line having one endpoint on said perimeter and one endpoint at its intersection with one of said first plurality of lines; and said plurality of logs is four.

9. The process of claim 8 wherein each said log is entirely sapwood and has a wedge-shaped cross-section and two generally rectangular and mutually orthogonal sides with straight-line grain.

10. The process of claim 1 wherein:

said first plurality of lines is five including a diametral line transiting the pith area and sapwood and heartwood in two opposed non-bud sectors, an outer pair of opposed lines, each line having endpoints proximate to said perimeter and transiting sapwood in one non-bud sector, and an inner pair of opposed lines, each line haveing endpoints proximate to said bouundary and transiting heartwood in one non-bud sector;

said second plurality of lines is nine including a diametral line transiting the pith area and sapwood and heartwood in two opposed non-bud sectors, an outer pair of opposed lines, each line having endpoints proximate to said perimeter and transiting sapwood in one non-bud sector, an inner pair of opposed lines the length of said outer pair of lines, each line transiting heartwood in one non-bud sector, and first and second pairs of opposed lines symmetric with respect to said diametral line, each line having an endpoint proximate to said perimeter and an endpoint at its intersection with one of said innier pair of lines of said first plurality of lines; and said plurality of logs is eight.

11. The process of claim 10 wherein each said log includes heartwood and sapwood, and has a generally rectangular cross-section and two opposed generally rectangular sides having straight-line grain.

* * * * *